US007980558B2

(12) United States Patent
Moore et al.

(10) Patent No.: US 7,980,558 B2
(45) Date of Patent: Jul. 19, 2011

(54) MULTIPLE SEQUENCED ROTATIONAL AIR VALVES FOR VACUUM TRANSPORT

(75) Inventors: Aaron Michael Moore, Fairport, NY (US); James Lawton Giacobbi, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 106 days.

(21) Appl. No.: 12/432,107

(22) Filed: Apr. 29, 2009

(65) Prior Publication Data

US 2010/0276868 A1 Nov. 4, 2010

(51) Int. Cl.
*B65H 5/02* (2006.01)

(52) U.S. Cl. ..... 271/276; 271/196; 198/803.5

(58) Field of Classification Search ..... 271/276, 271/194, 196, 197, 108; 198/803.5
See application file for complete search history.

(56) References Cited

U.S. PATENT DOCUMENTS 5,921,544 A * 7/1999 Benedict ..... 271/226
6,543,948 B2 * 4/2003 Beehler et al. ..... 400/635

* cited by examiner

*Primary Examiner* — Michael C McCullough
(74) *Attorney, Agent, or Firm* — Stuart I. Smith; Prass LLP

(57) ABSTRACT

A vacuum control assembly for use in an image production device is provided. The assembly has a plenum, a perforated plate, a plurality of valve assemblies, and a controller. Each valve assembly has a rotating valve having a vacuum passage, and a chamber body having a plurality of chambers. Each valve is rotatable between a first position that fluidly connects the vacuum passage with at least one of the chambers to complete a fluid path between the plenum and the perforated plate, and a second position at which the vacuum passage connects the plenum with none of the chambers. The controller controls the plurality of valve assemblies to provide vacuum to a first predetermined portion of the perforated plate while also providing no vacuum to a second predetermined portion of the perforated plate.

20 Claims, 4 Drawing Sheets

MULTIPLE SEQUENCED ROTATIONAL AIR VALVES FOR VACUUM TRANSPORT

BACKGROUND

Disclosed herein is a system and method for controlling the application of vacuum in a vacuum transport.

An example of an application for a vacuum transport is an image production device using direct marking print heads. The flatness and motion control requirements for direct marking print heads are extremely demanding. One strategy is to use a vacuum transport belt with ¼" hole spacing over a 28" vacuum plenum. To limit the leakage at the uncovered holes in the process and cross-process directions, the plenum can be divided into a number (for example four) chambers with a separate controllable blower at each chamber. The cost of these blowers is extremely high and there can be a large amount of leakage present. There are also issues related to how a sheet will pass from one chamber to another without losing its suction hold to the belt. In addition, plenum deflection can result, which may require ribbing or other supports to be added.

SUMMARY

A vacuum control assembly for use in an image production device is provided. The assembly has a plenum, a perforated plate, a plurality of valve assemblies, and a controller. Each valve assembly has a rotating valve having a vacuum passage, and a chamber body having a plurality of chambers. Each valve is rotatable between a first position that fluidly connects the vacuum passage with at least one of the chambers to complete a fluid path between the plenum and the perforated plate, and a second position at which the vacuum passage connects the plenum with none of the chambers. The controller controls the plurality of valve assemblies to provide vacuum to a first predetermined portion of the perforated plate while also providing no vacuum to a second predetermined portion of the perforated plate.

DETAILED DESCRIPTION

Aspects of the embodiments disclosed herein relate to a system and method for controlling the application of vacuum in a vacuum transport system.

The disclosed embodiments may include a vacuum control assembly for use in an image production device. The assembly has a plenum, a perforated plate, a plurality of valve assemblies, and a controller. Each valve assembly has a rotating valve having a vacuum passage, and a chamber body having a plurality of chambers. Each valve is rotatable between a first position that fluidly connects the vacuum passage with at least one of the chambers to complete a fluid path between the plenum and the perforated plate, and a second position at which the vacuum passage connects the plenum with none of the chambers. The controller controls the plurality of valve assemblies to provide vacuum to a first predetermined portion of the perforated plate while also providing no vacuum to a second predetermined portion of the perforated plate.

The disclosed embodiments may further include an image production device having a vacuum control assembly, a transport belt for transporting a sheet of medium across a perforated plate, and a media storage compartment for storing sheets of the media. The vacuum control assembly has a plenum, the perforated plate, a plurality of valve assemblies, and a controller. Each valve assembly has a rotating valve having a vacuum passage, and a chamber body having a plurality of chambers. Each valve is rotatable between a first position that fluidly connects the vacuum passage with at least one of the chambers to complete a fluid path between the plenum and the perforated plate, and a second position at which the vacuum passage connects the plenum with none of the chambers. The controller controls the plurality of valve assemblies to provide vacuum to a first predetermined portion of the perforated plate while also providing no vacuum to a second predetermined portion of the perforated plate.

The disclosed embodiments may further include a method of controlling a vacuum transport in an image production device. The method provides a plurality of valve assemblies, each valve assembly having a rotating valve having a vacuum passage, and a chamber body having a plurality of chambers. The method rotates at least one of the valves between a first position that fluidly connects its corresponding vacuum passage with at least one of the chambers in its corresponding chamber body to complete a fluid path between a plenum and a perforated plate, and a second position at which the vacuum passage connects the plenum with none of the chambers. The method controls the rotation of the valves to provide vacuum to a first predetermined portion of the perforated plate while simultaneously preventing the application of vacuum to a second predetermined portion of the perforated plate, and passes a transport belt carrying a sheet of media over the perforated plate.

Figure 1:
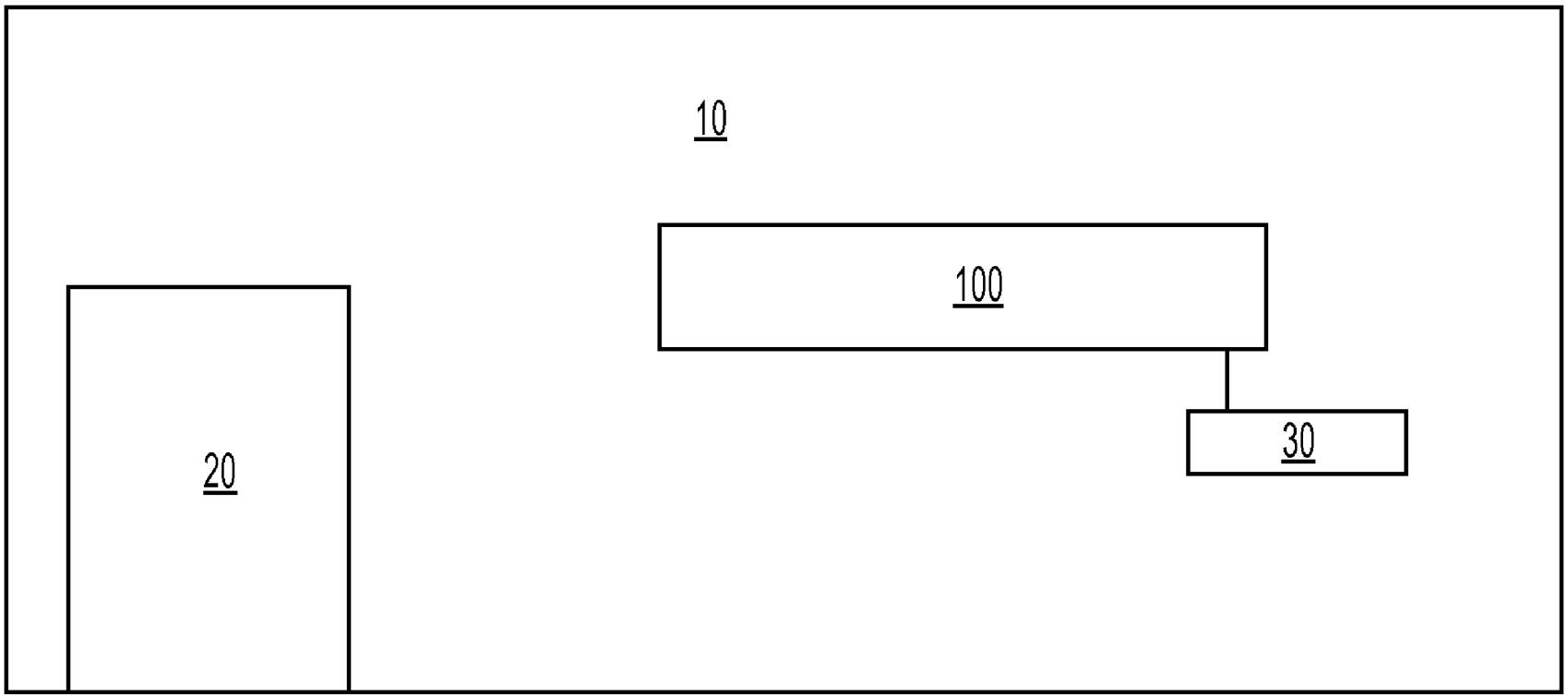
FIG. 1 is a schematic diagram of an exemplary image production device in accordance with one possible embodiment of the disclosure.

FIG. 1 is an exemplary schematic diagram of an image production device 10 in accordance with one possible embodiment of the disclosure. The image production device 10 can be any device that is capable of making image production documents (e.g., printed documents, copies, etc.) including a copier, a printer, a facsimile device, and a multi-function device (MFD), for example.

The image production device 10 can include a vacuum control assembly 100, a media stack 20, and a controller 30. Image production device 10 may have other elements that are not shown.

Although the following description is directed toward an image production device, it will be understood that the teachings herein can be applied to any transport system using vacuum.

Figure 2:
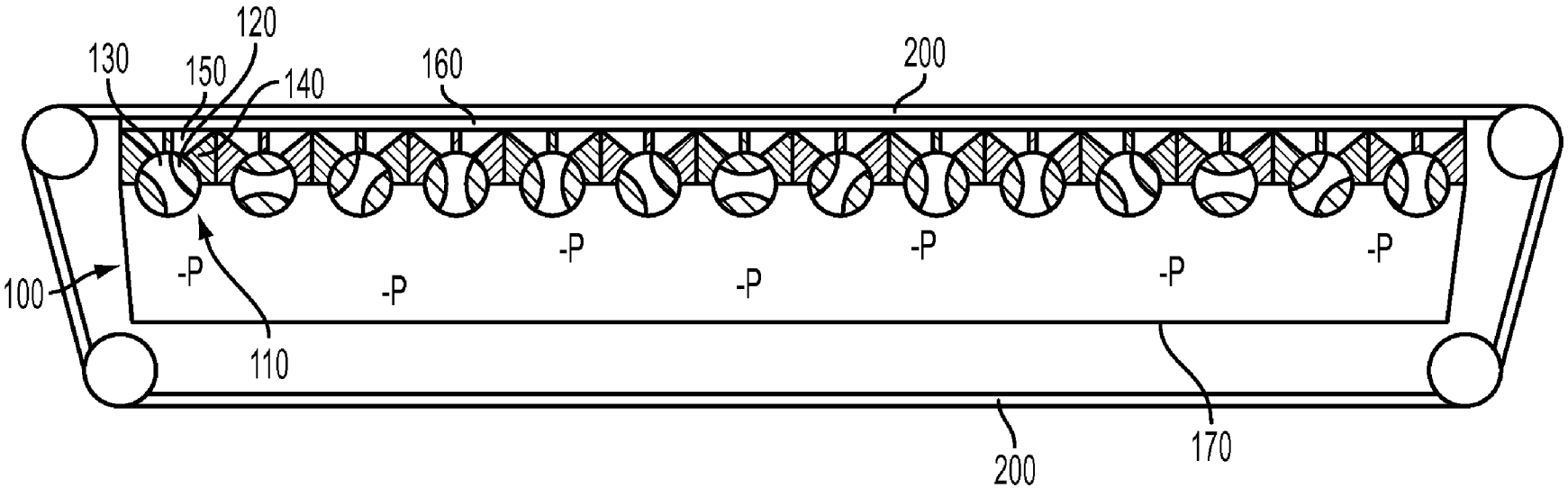
FIG. 2 is an exemplary diagram of a vacuum transport in accordance with one possible embodiment of the disclosure.

FIG. 2 is an exemplary diagram of vacuum control assembly 100 positioned inside a transport belt 200. In this example, transport belt 200 is a perforated belt that is positioned such that it travels adjacent to, and directly above, vacuum control assembly 100. This example of vacuum control assembly 100 has fourteen valve assemblies 110. Each valve assembly 110 has a rotating valve 120 positioned in a chamber body 140. Rotating valve 120 has at least one passage 130. Chamber body 140 has a plurality of chambers 150 (two in this example). A plenum 170 is located on the side of valve assemblies 110 adjacent to rotating valves 120. A perforated vacuum plate 160 is positioned on the side of valve assemblies 110 adjacent to chambers 150.

The use of plenum 170 makes it possible to use only one blower to provide the required vacuum to valve assemblies 110. Using a plenum also provides uniform vacuum to the valve assemblies, which can be difficult to obtain using multiple blowers.

Figure 3:
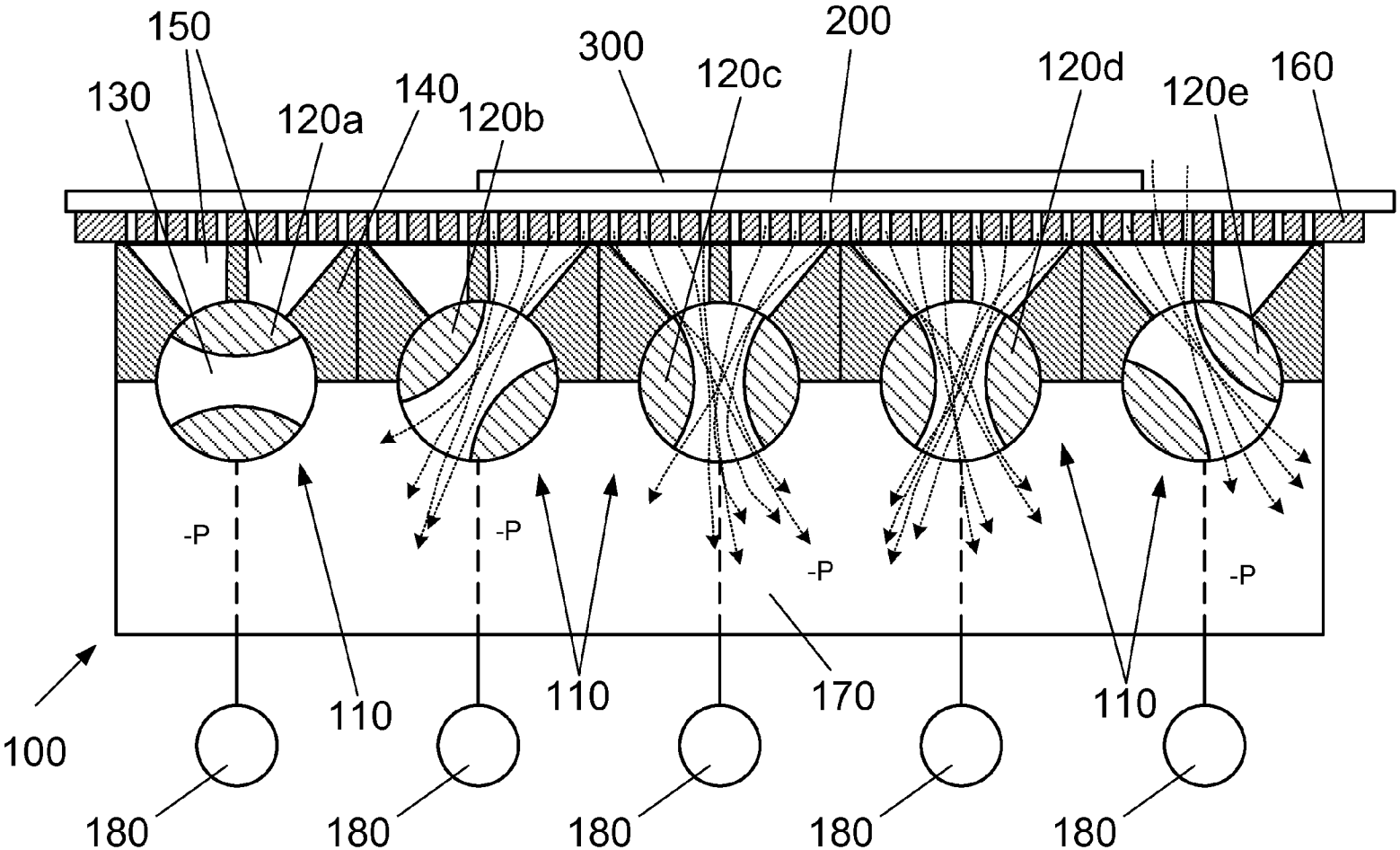
FIG. 3 is an exemplary diagram of a portion of a vacuum transport in accordance with one possible embodiment of the disclosure.

The operation of vacuum control assembly 100 will be described with reference to FIG. 3. FIG. 3 shows a portion of vacuum control assembly 100 having only five valve assemblies 110. A vacuum −P exists in plenum 170 as a result of a blower (not shown) or other vacuum creating device. Each rotating valve 120 is rotated so that its passage 130 is positioned in one of several positions.

Rotating valve 120*a* is positioned so that its passage 130 does not align with any chambers 150. As a result, the perforations in vacuum plate 160 associated with rotating valve 120*a* are not fluidly connected to plenum 170 and do not see negative pressure −P.

Rotating valve 120*b* is positioned so that its passage 130 aligns with only the right hand side chamber 150 in its chamber body 140. As a result, only half of the perforations in vacuum plate 160 associated with rotating valve 120*b* are fluidly connected to plenum 170 and see negative pressure −P.

Rotating valve 120*e* is positioned similarly to rotating valve 120*b*, except that its passage 130 aligns with only the left hand side chamber 150 in its chamber body 140. As a result, only half of the perforations in vacuum plate 160 associated with rotating valve 120*e* are fluidly connected to plenum 170 and see negative pressure −P.

Rotating valve 120*c* is positioned so that its passage 130 aligns with both chambers 150 in its chamber body 140. As a result, all the perforations in vacuum plate 160 associated with rotating valve 120*c* are fluidly connected to plenum 170 and see negative pressure −P. Rotating valve 120*d* is in a position similar to that of rotating valve 120*c*.

In FIG. 3, a sheet of paper 300 is held in place on transport belt 200 by negative pressure −P that is communicated through the perforations in vacuum plate 160 by rotating valves 120*b*, 120*c*, 120*d*, and 120*e*. As paper 300 is moved to the right in FIG. 3 by transport belt 200, the rotating valves will rotate to provide vacuum to only those chambers 150 over which paper 300 is positioned. Leakage can occur at some positions in this process. In FIG. 3 leakage is shown at the right of paper 300 (the leading edge) as a result of rotating valve 120*e*. While this example of the disclosure can allow leakage, far less leakage exists than in conventional vacuum transports. Also, controlled leakage (at the leading edge of the sheet, for example) can be beneficial in keeping the sheet secured to transport belt 200.

Figure 4:
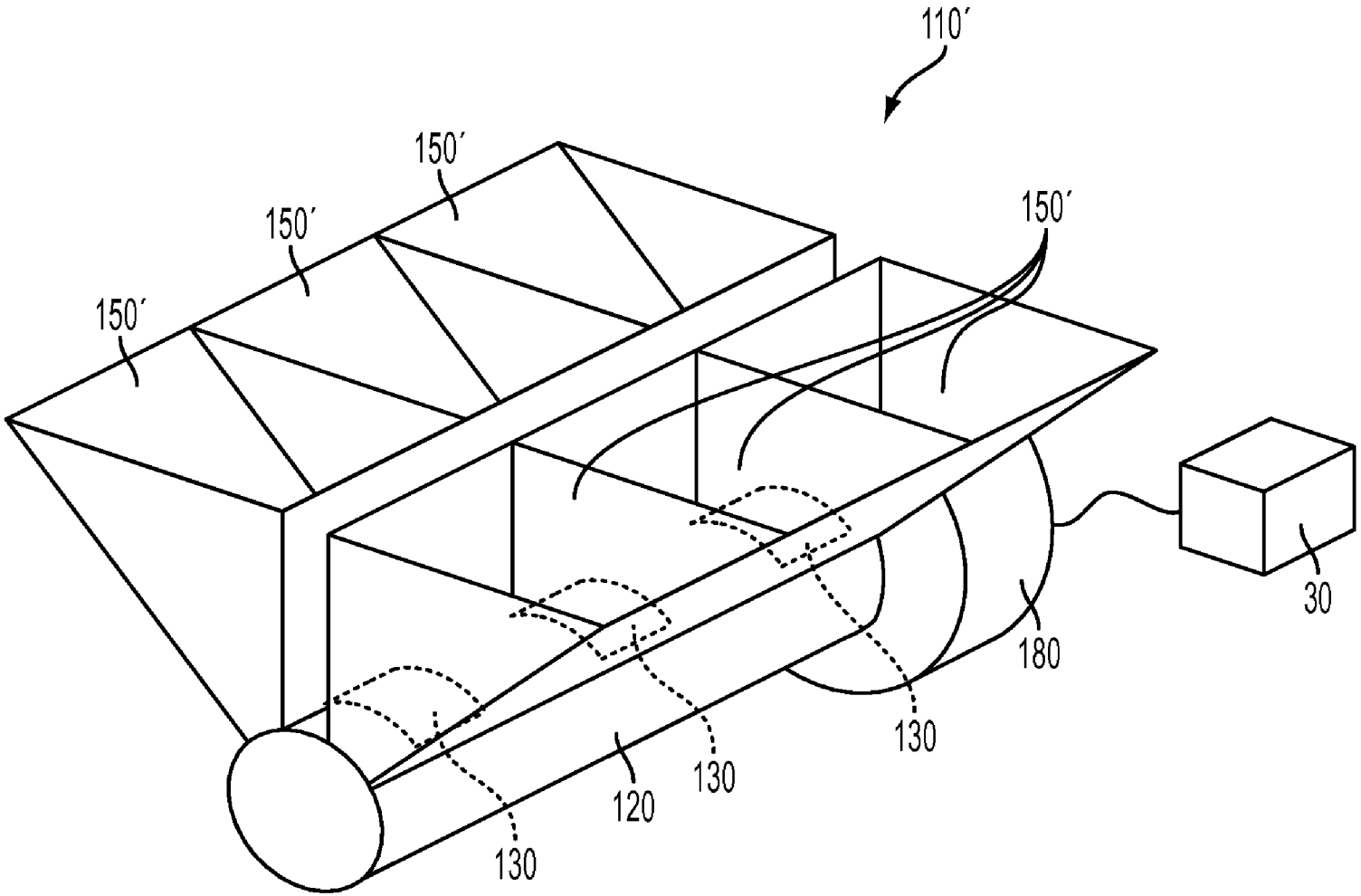
FIG. 4 is an exemplary perspective view of a portion of a vacuum transport in accordance with one possible embodiment of the disclosure.

FIG. 4 is a partial perspective view of a valve assembly 110' in accordance with one possible embodiment of the disclosure. In this example, each chamber is partitioned into three sub chambers 150'. This example lends itself to controlling leakage in the cross-processing direction. Also shown in FIG. 4 is one possible location of a motor 180 for rotating valve 120. Controller 30 controls motor 180 to coordinate the rotation of valve 120 with the other valves in the assembly. Each rotating valve 120 can be rotated by a different motor or two or more rotating valves can be rotated by one motor. FIG. 3 shows an exemplary embodiment in which each valve 120 is rotated by a different motor 180.

The leakage allowed by the vacuum control assembly can be reduced by decreasing the length of the chambers. For example, a vacuum control assembly having a length of 28 inches can have fourteen 2 inch valve assemblies. If each valve assembly has two chambers, each chamber is approximately one inch long. In this example, proper control of the rotating valves results in a maximum leakage of less than two inches. If, however, a 28 inch vacuum control assembly has twenty-eight 1 inch valve assemblies (each having two chambers), each chamber is approximately ½ inch long. As a result, proper control of the rotating valves results in a maximum leakage of less than one inch.

Each chamber body 140 in the example shown in FIG. 3 has two chambers in the process direction. Other examples can use chamber bodies having more or less than two chambers.

Other advantages of possible embodiments of the disclosure are (1) leading edge and trailing edge leakage is easily controlled regardless of paper size and inner document gap, (2) multiple sheets can be handled simply on the transport while maintaining a small amount of leakage, (3) the modular design gives the ability to increase or decrease the length of the vacuum transport as needed for different projects or changes that may occur during the design phase of any given product, (4) the low profile of the vacuum control assembly helps reduce machine space, belt length, and chamber ducting, (5) the chamber bodies can stiffen the top of the plenum, the deflection of which is a concern in conventional systems, (6) the short paths between the plenum and the vacuum plate create near instant suction at the plate when the valves are opened, (7) drag force between the belt and vacuum plate can be reduced by turning off suction in the inner document gap, and (8) drag can be further reduced by turning off the valves that lie under the sheet, keeping only the leading edge and trailing edge valves open at any given time.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A vacuum control assembly for use in an image production device, the assembly comprising:

a plenum;

a perforated plate;

a plurality of valve assemblies, each valve assembly having a rotating valve member and a vacuum passage passing through the valve member, and a chamber body having a plurality of chambers, the vacuum passage being capable of simultaneously fluidly connecting the plenum to all chambers of the plurality of chambers, the valve member being rotatable between a first position that fluidly connects the vacuum passage with at least one chamber of the plurality of chambers but not all chambers of the plurality of chambers to complete a fluid path between the plenum and the perforated plate, and a second position at which the vacuum passage connects the plenum with none of the plurality of chambers; and a controller that controls the plurality of valve assemblies to provide vacuum to a first predetermined portion of the perforated plate while also providing no vacuum to a second predetermined portion of the perforated plate.

2. The assembly of claim 1, wherein the valve member is rotatable to a third position that fluidly connects the vacuum passage with all of the chambers of the plurality of chambers in one of the chamber bodies.

3. The assembly of claim 2, where each valve member is rotated by a separate motor.

4. The assembly of claim 1, further comprising a motor for rotating the valve members.

5. The assembly of claim 4, where each valve member is rotated by a separate motor.

6. The assembly of claim 1, wherein the first predetermined portion of the perforated plate corresponds to a sheet of medium on which an image is to be produced by the image production device.

7. The assembly of claim 1, wherein each chamber is separated into a plurality of sub-chambers along a direction that is parallel to an axial direction of the valve member.

8. The assembly of claim 1, wherein the valve assemblies are modular.

9. An image production device, comprising:

a vacuum control assembly having a plenum;

a perforated plate;

a plurality of valve assemblies, each valve assembly having a rotating valve member and a vacuum passage passing through the valve member, and a chamber body having a plurality of chambers, the vacuum passage being capable of simultaneously fluidly connecting the plenum to all chambers of the plurality of chambers, the valve member being rotatable between a first position that fluidly connects the vacuum passage with at least one chamber of the plurality of chambers but not all chambers of the plurality of chambers to complete a fluid path between the plenum and the perforated plate, and a second position at which the vacuum passage connects the plenum with none of the plurality of chambers; and a controller that controls the plurality of valve assemblies to provide vacuum to a first predetermined portion of the perforated plate while also providing no vacuum to a second predetermined portion of the perforated plate;

a transport belt for transporting a sheet of medium across the perforated plate; and a media storage compartment for storing sheets of the media.

10. The device of claim 9, wherein the valve member is rotatable to a third position that fluidly connects the vacuum passage with all of the chambers of the plurality of chambers in one of the chamber bodies.

11. The device of claim 10, where each valve member is rotated by a separate motor.

12. The device of claim 9, further comprising a motor for rotating the valve members.

13. The device of claim 12, where each valve member is rotated by a separate motor.

14. The device of claim 9, wherein the first predetermined portion of the perforated plate corresponds to the sheet of medium.

15. The device of claim 9, wherein each chamber is separated into a plurality of sub-chambers along a direction that is parallel to an axial direction of the valve member.

16. The assembly of claim 9, wherein the valve assemblies are modular.

17. A method of controlling a vacuum transport in an image production device, the method comprising:

providing a plurality of valve assemblies, each valve assembly having a rotating valve member and a vacuum passage passing through the valve member, and a chamber body having a plurality of chambers, the vacuum passage being capable of simultaneously fluidly connecting a plenum to all chambers of the plurality of chambers;

rotating at least one of the valve members between a first position that fluidly connects a corresponding vacuum passage with at least one chamber of the plurality of chambers but not all chambers of the plurality of chambers in a corresponding chamber body to complete a fluid path between the plenum and a perforated plate, and a second position at which the vacuum passage connects the plenum with none of the plurality of chambers;

controlling the rotation of the valve members to provide vacuum to a first predetermined portion of the perforated plate while simultaneously preventing the application of vacuum to a second predetermined portion of the perforated plate; and passing a transport belt carrying a sheet of media over the perforated plate.

18. The method of claim 17, further comprising:

rotating at least one of the valve members to a third position that fluidly connects a corresponding vacuum passage with all of the chambers of the plurality of chambers in a corresponding chamber body.

19. The method of claim 18, wherein each valve member is rotated by a separate motor.

20. The method of claim 17, wherein the valve assemblies are provided in a modular form.

* * * * *